United States Patent [19]

Roberts et al.

[11] Patent Number: 4,759,140

[45] Date of Patent: Jul. 26, 1988

[54] MOTION BOARD DRIVE SYSTEM

[75] Inventors: William D. Roberts, Kirk Michael; Graham M. Stopford, Port Erin, both of Isle of Man

[73] Assignee: Edward J. Moen, Tulsa, Okla.

[21] Appl. No.: 893,939

[22] Filed: Aug. 6, 1986

[30] Foreign Application Priority Data

Oct. 10, 1985 [GB] United Kingdom ..... 8524998

[51] Int. Cl.[4] ..... G09F 19/00

[52] U.S. Cl. ..... 40/466; 40/429; 40/473; 40/503

[58] Field of Search ..... 40/470, 466, 503, 471, 40/475, 429

[56] References Cited

U.S. PATENT DOCUMENTS 1,051,788 1/1913 Wagner ..... 40/466
1,652,335 12/1927 Wiley ..... 40/470
2,202,417 5/1940 Fleming ..... 40/502
3,919,794 11/1975 Hunter ..... 40/502

FOREIGN PATENT DOCUMENTS 330037 6/1930 United Kingdom ..... 40/470

*Primary Examiner*—Gene Mancene
*Assistant Examiner*—Wenceslao J. Contreras
*Attorney, Agent, or Firm*—Head & Johnson

[57] ABSTRACT

A logic control linear drive magnetic motor is used to reciprocate approximately 180° the flat panels which make a display board. Each panel of the display board is connected to a pulley which is in a plane perpendicular to the longitudinal dimension of the vane. A continuous drive cord is connected to each end of a shuttle cylinder of the motor and is wrapped around the pulley drum. Movement of the shuttle cylinder moves the drive cord which controls the rotation of the vanes.

28 Claims, 10 Drawing Sheets

MOTION BOARD DRIVE SYSTEM

BACKGROUND OF THE INVENTION

This invention is related to an electromechanical display system which alternately displays two different messages or illustrations displayed on opposite sides of flat vanes which make two display areas. It relates especially to a new system for driving the vanes between alternate positions.

There is presently being developed a system for alternating advertising messages where Message One and Two are alternately displayed to one audience. It includes a frame which supports a first set of a plurality of vanes or strips which are pivotally suspended from the frame. The pivots define a line which is normally straight. When the vanes are rotated to alignment in one direction they form a surface upon which Display One is shown. On the reverse side of the vanes, there is a jumbled Display Two. When the vanes are each rotated 180°, Display Two, instead of Display One, is visible to the observe. A rotating electrical motor is mechanically connected to each of the vanes for alternately driving them in one direction and then the other.

It is an object of this invention to disclose a completely new driving system for alternating billboards or the like.

It is a further object of this invention to provide a driving system which is quiet and has a very long life.

SUMMARY OF THE INVENTION

This is a linear magnetic motor for driving an alternating billboard. The alternating billboard includes a frame which supports a set of a plurality of vanes or strips or panels which are relatively flat and are pivotally suspended from the frame. When the vanes are rotated to alignment in one direction, they form a display surface upon which Display One is shown. When the vanes are rotated approximately 180°, Display Two instead of Display One is visible to the observer. We have a novel way of driving these vanes between one position and a second position. It includes a logic coil linear motor which drives a continuous drive cord which makes a loop which is connected to each end of a shuttle cylinder in the motor. In a preferred embodiment, the top end of each vane is connected to a pulley or drum. The drive cord is looped about each of these pulleys and the length of the drive cord is adjusted so that it is quite taut. Then movement of the shuttle cylinder within the motor causes the drive cord to move, which in turn causes the vane pulleys to rotate and as the vanes are mechanically fastened to the drive pulleys, then the vanes also rotate.

The logic coil motor is made up of a selected number, e.g. four coils. A logic control is provided to a motor driver so that the motor can be programmed to alternate at any repetition rate that is desired. The logic control also goes to an accessory driver so that music, lights and so forth can be coordinated with the selected rotation of the display vanes.

In an especially preferred embodiment, plate and clutch means are provided with the pulley drive for each vane so that the rotation of the vane with respect to each other can be finely tuned. Adjustable magnetic lock or brake means are also provided so that the shuttle cylinder will come to a complete rest at the end of each stroke instead of vibrating. Means are also provided to reduce the effective weight of the shuttle cylinder on its support bearings.

DETAILED DESCRIPTION OF THE PREFERRED EMBODIMENT

Figure 3:
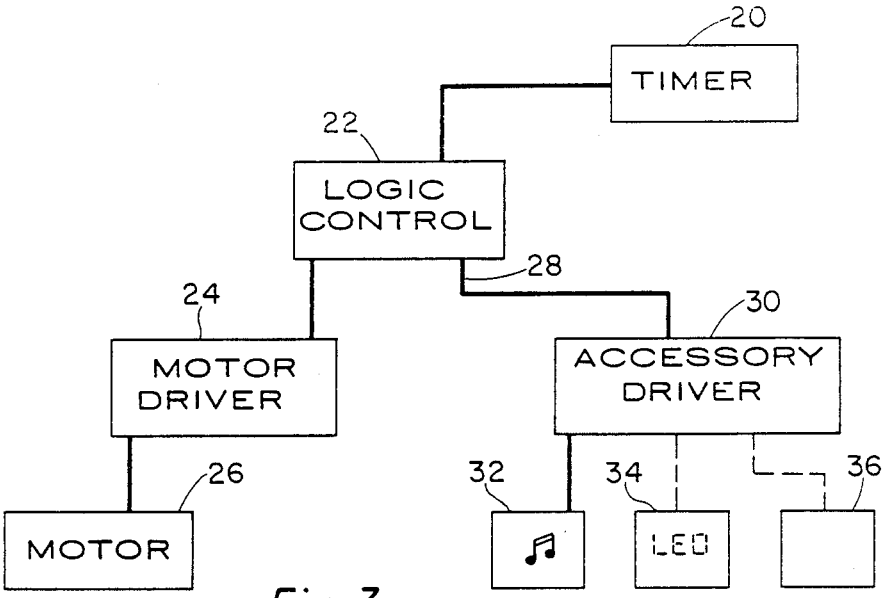
FIG. 3 is a block diagram showing the timer control and motor drive.
Figure 1:
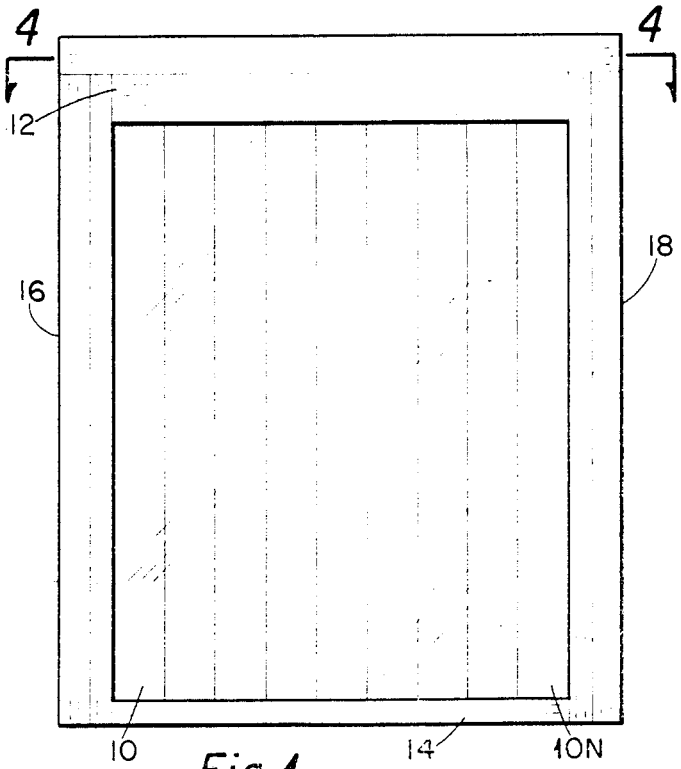
FIG. 1 illustrates a Motion Board Display having a plurality of vanes or panels.
Figure 2:
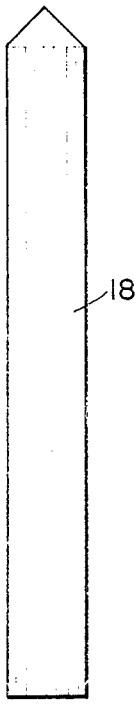
FIG. 2 is an end view of FIG. 1.

Attention is first directed to FIG. 1 which shows a Motion Board Display System which has a plurality of vanes or panels 10, a top frame 12, a bottom frame 14 and side frames 16 and 18. The vanes 10 form a large display area within the frames. A portion of the display is on each elongated vane 10 through 10*n*. The reverse side of the vanes 10 to 10*n* comprises a second display area upon which a second display or Display can be provided, thus, by rotating the vanes 10 to 10*n* by approximately 180°, the Display or display can be changed from Display One to Display Two. We will now turn to FIG. 3 which shows the block diagram showing how the vanes' rotation are controlled. Shown in FIG. 3, is a timer 20 which is connected to a logic control 22 whose output is connected to the input of motor driver 24 which may include a power amplifier to increase the power from the logic control to drive the motor 26. In some cases a power amplifier may not be needed. Timer 20 can be any suitable clocking timer which can be adjusted to have an output signal with the desired time occurrence. The signal from the timer 20 is fed to a logic control circuit 22 which is any convenient logic control circle which upon receiving a selected output pulse from timer 20 is programmed to activate motor driver 24 which can provide an electric current to motor 26 at designated times and for durations as dictated by the logic control circuit 22. Logic control circuits are well known and it is not considered necessary to go into details on this item. The logic control circuit can also have a second output 28 which is connected to an accessory driver 30 which upon receiving a selected control signal on conduit 28 can actuate the proper accessory. For example, a first control signal is used to actuate music from means 32, while a second signal could be used to control light circuit 34 and a third control signal could be used to control any desired accessory 36. The motor 26 and accessories may be driven by separate power supplies.

Figure 4:
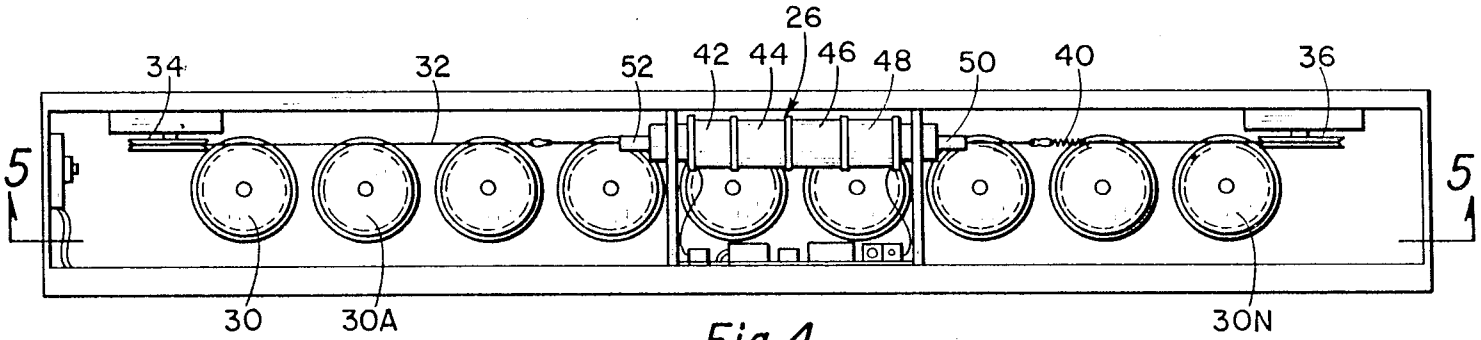
FIG. 4 is a view taken along the line 4—4 of FIG. 1.
Figure 5:
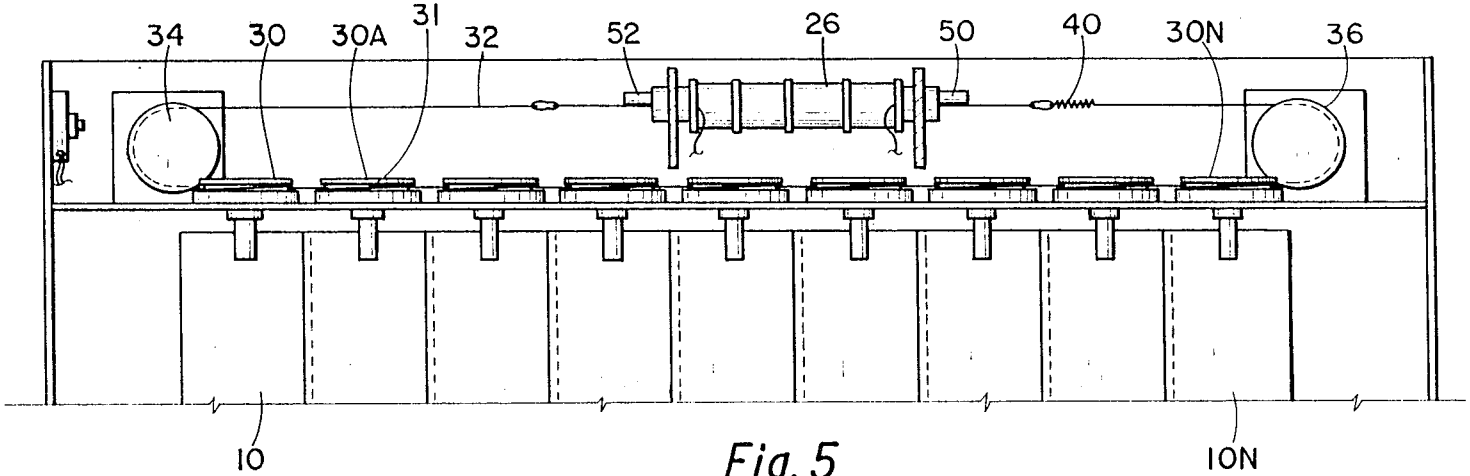
FIG. 5 is a view taken along the line 5—5 of FIG. 4.
Figure 6:
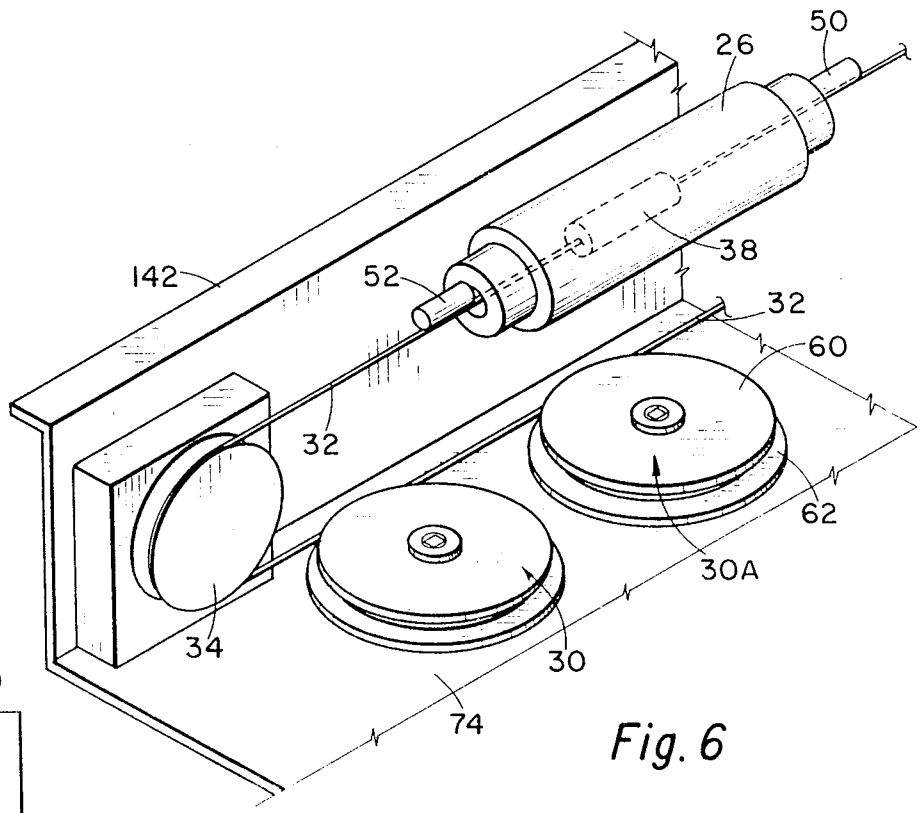
FIG. 6 is an enlarged view showing the logic coil motor and a part of the drive cord system.

Attention is next directed to FIGS. 4 and 5 for a more detailed description of our drive system for driving the panels 10 to 10*n*. Shown thereon is a drive cord 32 and a plurality of drive cord pulleys 30, 30*a* to 30*n* about which the drive cord 32 is lapped or wrapped. The cord 32 may be fixed to a point on each pulley 30 as indicated at 31 by glue or other means. This improves the positive rotation of the pulley with respect to the movement of cord 32. In the embodiment illustrated, the vane drive pulleys 30 are in a horizontal position. The drive cord 32 also goes around control or stabilizing pulleys 34 and 36 which are in a vertical plane in the embodiment shown. The drive cord 32 is connected to a shuttle cylinder 38 within logic coil motor 26 as shown in FIG. 6. A tension spring 40 is provided in the drive cord. The logic motor 26 as shown is a linear magnetic type motor which has four coils 42, 44, 46 and 48. It should be noted that any number of coils can be used to give the desired movement of the shuttle cylinder 38 as it may receive signals from the logic control 22. The movement of the shuttle cylinder 38 is such that in one direction, it will cause the panels 10 to exhibit a first plane display surface and when in the other end of the movement it will cause the vanes 10 to rotate approximately 180° so that the opposite side of the vanes 10 will show a second display area which is in view of the observer which formally observed the first display area. If desired, the logic can be set such as to cause the vanes to rotate less than 180°. For example, they could rotate 90° so that for a moment, a person could "see through" the vane area. Adjustable magnetic locks 50 and 52 supported from frame 142 are also provided. These permanent magnets limit the movement of the shuttle cylinder 38 once the electricity is cut off to the coils. These magnetic locks are spaced in regard to the end of movement of shuttle cylinder 38 so that the magnetic field therefrom will hold the shuttle cylinder 38 at its desired position and will eliminate nearly all flutter on drive cord 32 which flutter would translate into a fluttering of the vanes 10. It is desired to have the vanes 10 come to a complete rest at the end of each rotational cycle. Magnets 50 and 52 may be either permanent magnets or they may be electromagnets. They may also be permanent magnets with an electromagnet surrounding it. Other locking mechanisms will be described herein later.

Figure 7A:
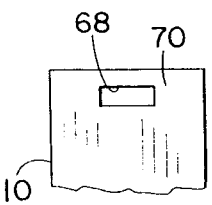
FIG. 7A shows a portion of a vane which fastens to the vane clip of FIG. 7.
Figure 7:
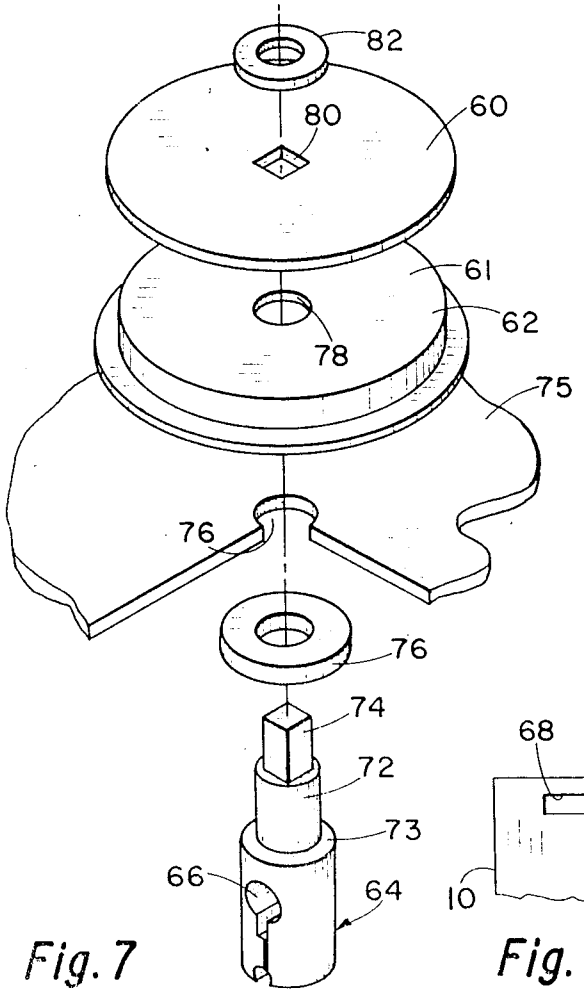
FIG. 7 is an exploded view of means to connect the vanes to the drum which is driven by the drive cord.

Attention is next directed to FIG. 7 in conjunction with FIG. 6. It is important that when the vanes 10 are rotated in one direction that they all be aligned so that they present a reasonably flat display surface. Sometimes it may be difficult to place the drive cord 32 about the pulley means 30, 30*a*, etc., so that the vanes are thus aligned as desired. With the device illustrated in FIG. 7, I can accomplish this easily, by rotating a friction or clutch plate 60 with respect to the drum 62 upon which the cord 32 is wound. As can be seen in FIG. 7, there is a vane clip 64 having an opening 66 into which the strip 70 of vane 10 above slot 68 (as shown in FIG. 7A) fits. The vane clip 64 is provided with a spindle 72 which is cylindrical and which has a rectangular key 74 just above that. A support bushing 76 which has a circular hole 76 through which spindle 72 extends. Support bushing 76 rests on shoulder 73 of vane clamp 64 and frame base 75 is in contact with the top of support bushing 76. Drum 62 is provided with a round hole 78 which also fits down over the cylindrical section of the key spindle. It is about this drum 62 that the drive cord 32 is wound. Mounted on top of the drum 62 is a friction or clutch plate 60 which has a square hole 80 which fits on rectangular key 74. A spring lock mechanism 82 fits over key 74 to hold the parts shown in FIG. 7 together when assembled. When the device of FIG. 7 is assembled so that the cord is wound around the drum 62 as shown in FIG. 6 and if the vanes 10 are not properly aligned, then all one has to do is to release the spring lock 82, lift friction or clutch plate 60 up from face 61 or drum 62 and rotate the out of position vane to the proper position. If the shuttle cylinder 38 is not moving then the cord 32 is not moving and the drum 62 will stay stationary during this operation. Once the vane is properly aligned, friction plate 60 is lowered against face 61 of drum 62 and the spring lock 82 is again assembled onto key 74.

Figure 8:
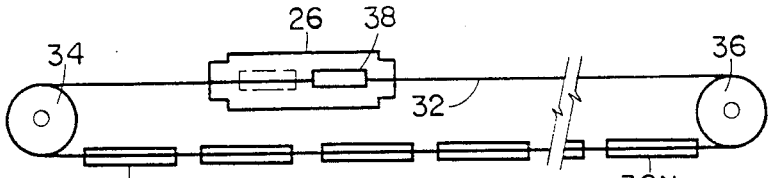
FIG. 8 is a schematic diagram of the drive mechanism of FIG. 4.
Figure 9:
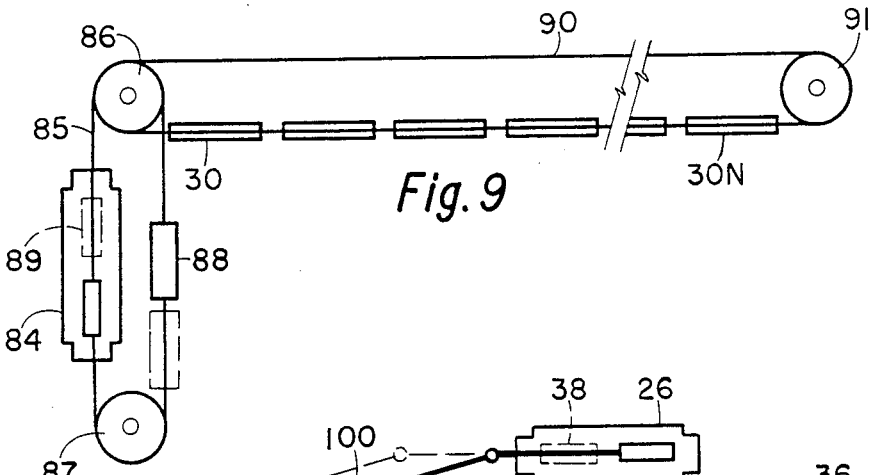
FIG. 9 is a schematic diagram of another drive mechanism embodiment.

FIG. 8 shows the schematic drawing of the embodiment just described in relation to FIGS. 4, 5, 6 and 7. It shows the motor 26 with shuttle cylinder 38, drive cord 32 with end pulleys 34 and 36 and vane drive pulleys 30 to 30*n* with axis in a plane perpendicular to the plane defined by the axis of pulleys 34 and 36. Other arrangements of this Motion Board Drive System can be had. In FIG. 9, shuttle motor 84 is in a vertical position and has a continuous cord 85 which encircles pulleys 86 and 87. A counter weight 88 of approximately the same weight as the shuttle cylinder 89 is provided in the cord 85. Pulley 86 is a two wheel or groove pulley and has a second drive cord 90 in the other groove not occuppied by cord 85. The cord 90 also goes around end pulley 91 and connects to vanes 30 to 30*n* similarly as did that system shown in FIG. 8. The linear motor 26 was moved out of the cord 32 and placed in a vertical position on cord 85 so that we can use a counter weight 88 to eliminate most of the effect of the weight of the shuttle cylinder 89.

Figure 10:
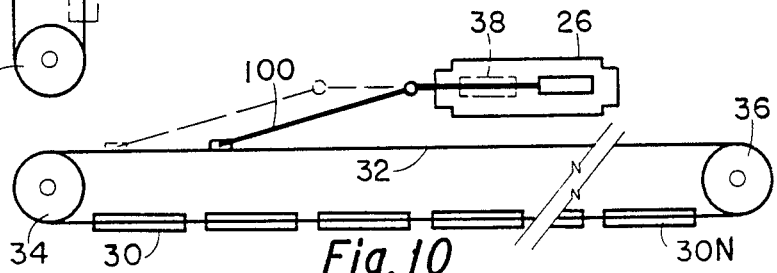
FIG. 10 is a schematic diagram of still another drive system.

FIG. 10 is still a further modification of that of FIG. 8. Here the linear motor 26 has a shuttle cylinder 38 connected via push rod 100 to cord 32. Here we are pushing and pulling segments of cord 32 with the connecting rod 100 in accordance with the movement of shuttle cylinder 38.

Figure 11:
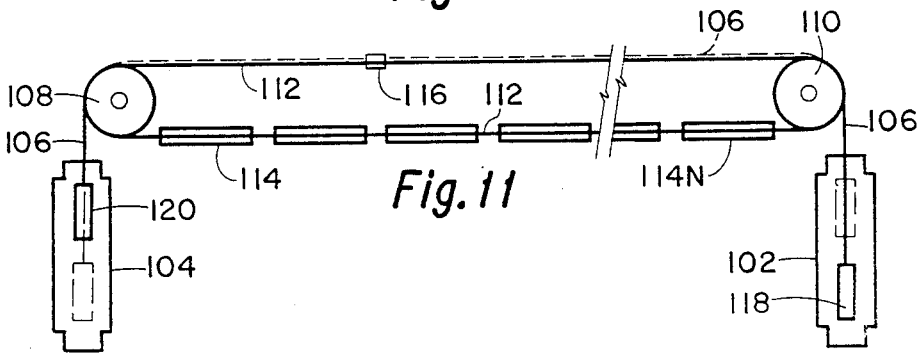
FIG. 11 is a schematic diagram of still another embodiment of the drive system.

FIG. 11 is still a further embodiment. It has twin linear motors 102 and 104 which are connected by drive cord 106. Also provided are double grooved twin pulleys 108 and 110. The cord 106 goes into one groove of each of the pulleys 108 and 110 and a second drive cord 112 goes over the grooves of the two pulleys. The drive cord 112 drives the vane cylinders 114 to **114*n*. Drive cord 106 and drive cord 112 are mechanically connected at 116 so that movement of cord 106 is translated to drive cord 112. The wiring for the linear motors 102 and 104 are such that when shuttle cylinder 118 of motor 102 is in its lower most position, shuttle cylinder 118 of motor 104** is in its upper most position.

Figure 12:
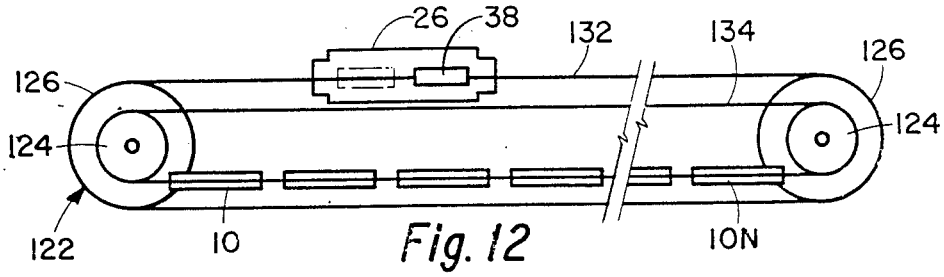
FIG. 12 is a schematic diagram of still another embodiment under the drive system.

Attention is next directed to FIG. 12 which shows a schematic diagram of a pulley arrangement so that there is a ratio between the movement of the shuttle cylinder and that of the drive cord. Shown thereon is a double pulley 122 having a smaller diameter pulley 124 and a larger outer diameter 126. A similar pulley is provided on the right hand end of the drawing. A motor 26 having shuttle cylinder 38 and drive cord 32 is mounted on a larger drive cord 132. A second drive cord 134 which is connected to vanes 10 to **10*n* are mounted on the smaller pulley 124, thus, it is clear that the ratio of the movement of drive cord 132 to second drive cord 134 is directly proportional to the ratio of the radius of the smaller pulley 124 and the larger pulley 126**.

Figure 13:
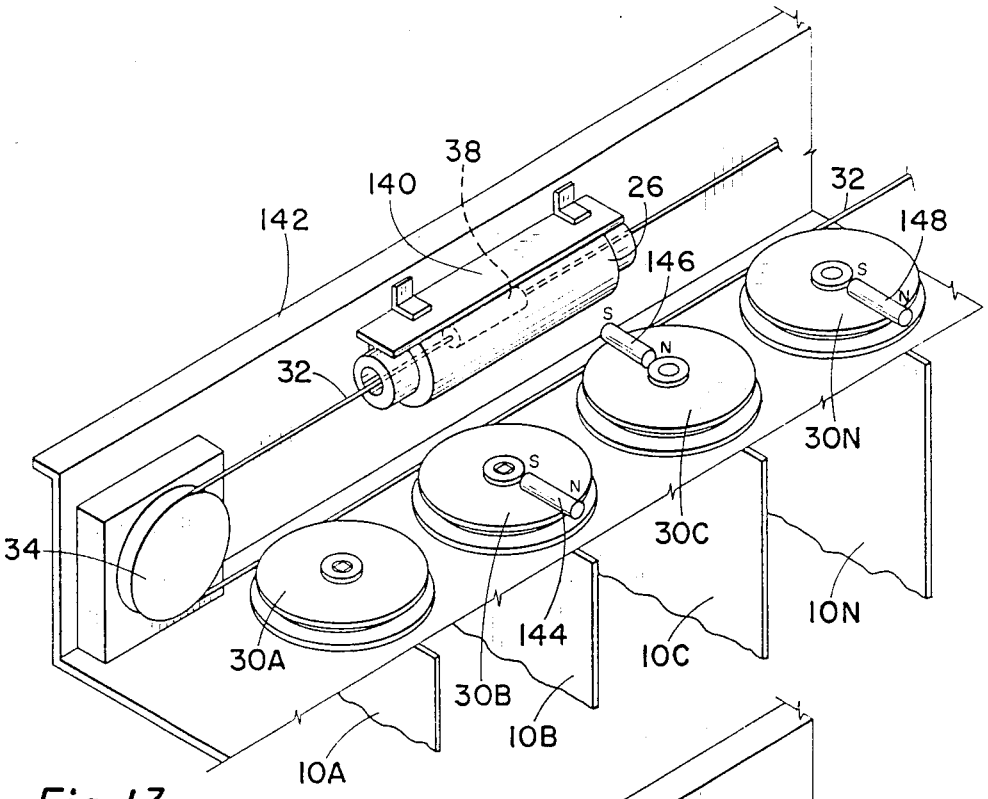
FIG. 13 illustrates the position of an iron plate to reduce the effective weight of the shuttle cylinder on its support bearings and also includes magnetic latching means.

In order to improve the efficiency of the motor when used horizontally, a horizontal steel plate 140 supported from frame 142 as shown first in FIG. 13, is positioned above the motor 26 so that the motor magnet or shuttle cylinder 38 will be attraced towards this plate thereby levitating the magnet—this action will reduce the force between the magnet and its surrounding tube or bearings—thereby reducing the friction between these two parts and making more power available to turn the vanes. It also reduces frictional wear between the parts thereby extending the mechanical life of the motor.

Other latching means for preventing flutter of the vanes will now be discussed. It is also possible to provide a magnetic lock using a stationary magnet positioned horizontally between two drive cord pulleys so that each end of the magnet is close to the circumference of the two adjacent drive cord pulleys. If a horizontal magnet or piece of soft iron or steel is then attached radially to the top of each drive cord pulley 32 that when the vanes are closed up in one direction then one magnet is adjacent to the stationary magnet then the vanes will be held in the closed position—when the vanes rotate then the other magnet will become adjacent to the other end of the stationary magnet to again hold the vanes closed. It is further noted that magnets may be fitted to the drive cord pulleys and a stationary piece of soft iron or steel may be used. Various alternative solutions can be seen to be possible by using, for example, independent locking systems where a lock in one direction can be achieved using one drive cord pulley and the other lock using a separate system on a remote drive cord pulley. Another solution is to use three adjacent drive cord pulleys and transfer the stationary magnet to the center drive cord pulley. A further solution is to put the magnet locks between a magnet mounted on the cord and stationary parts. Furthermore, if it is considered unimportant to conserve power, the hold may be achieved by keeping the end coil energized—at full power or reduced power.

Figure 14:
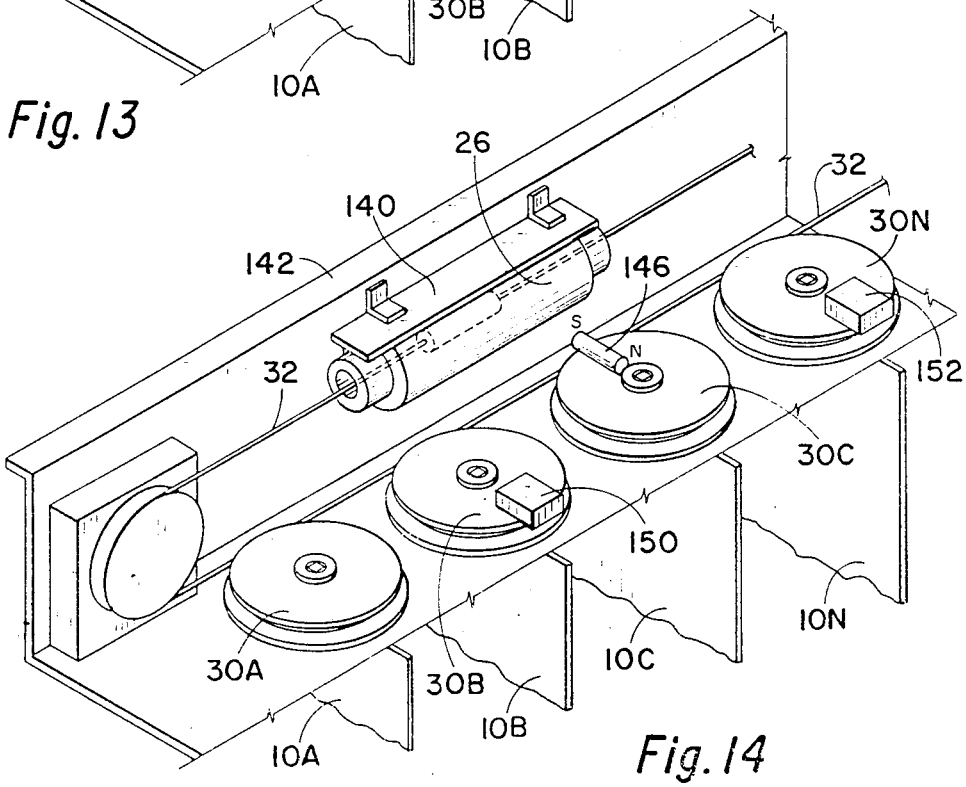
FIG. 14 is similar to 13 except it shows a different arrangement of magnetic latching means for preventing flutter.

We will now discuss some specific means or arrangements of magnetic locks for the drive cord shown in FIGS. 13 through 25. Attention is first directed to FIG. 13 and shown thereon are a plurality of vanes 10A, 10B, 10C, and 10N, which are attached to drums 30A, 30B, 30C, and 30N, respectively, so that rotation of the drums rotates the vanes. The magnetic locking mechanism of this embodiment of FIG. 13 includes a magnet 144 on drum 30B, magnet 146 on drum 30C, and magnet 148 on drum 30N. When the drums rotate approximately ninety degrees from the position shown in FIG. 13, in one direction, for example, the south pole of magnet 146 will be adjacent to the north pole of magnet 148. This causes a locking effect and when the motor 26 is not energized, the strength of the magnets will hold the drums in a steady position to prevent flutter. When the drums rotate in the opposite direction approximately one-hundred-eighty degrees (ninety degrees from that shown), the south pole of magnet 146 will be adjacent the north pole of magnet 144 and it will likewise hold the drums against flutter in that direction when the motor 26 has reached its limit and has stopped. FIG. 14 is quite similar to FIG. 13 except that magnets 144 and 148 on drums 30B and 30N have been replaced, respectively, by iron or steel masses 150 and 152 being adjacent the magnet 146 and when the power was cut off on the motor the magnet would hold the cord 32 in a position as to prevent flutter. Similarly, when the vanes are rotated to a position approximately ninety degrees in the opposite direction from that shown here and approximately one-hundred-eighty-degrees from that which we just described, then the magnet 146 would be an adjacent magnet of iron mass 150.

Figure 15:
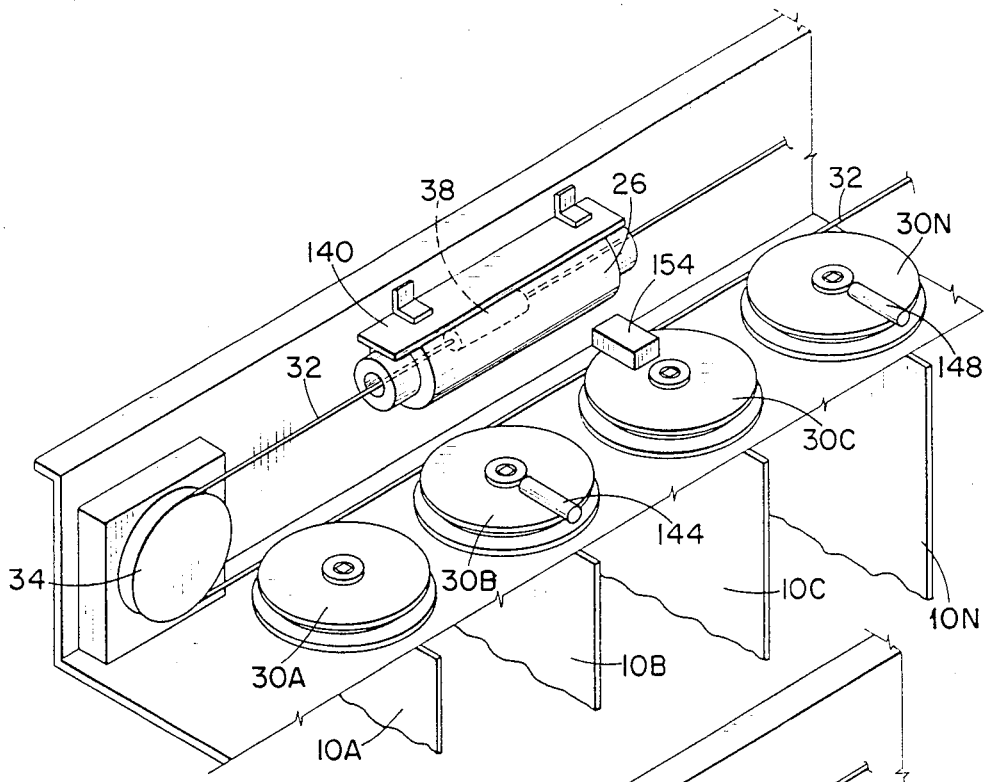
FIG. 15 is still another embodiment of magnetic latching means utilizing an iron mass on a center drum and magnets on the two adjacent drums.
Figure 16:
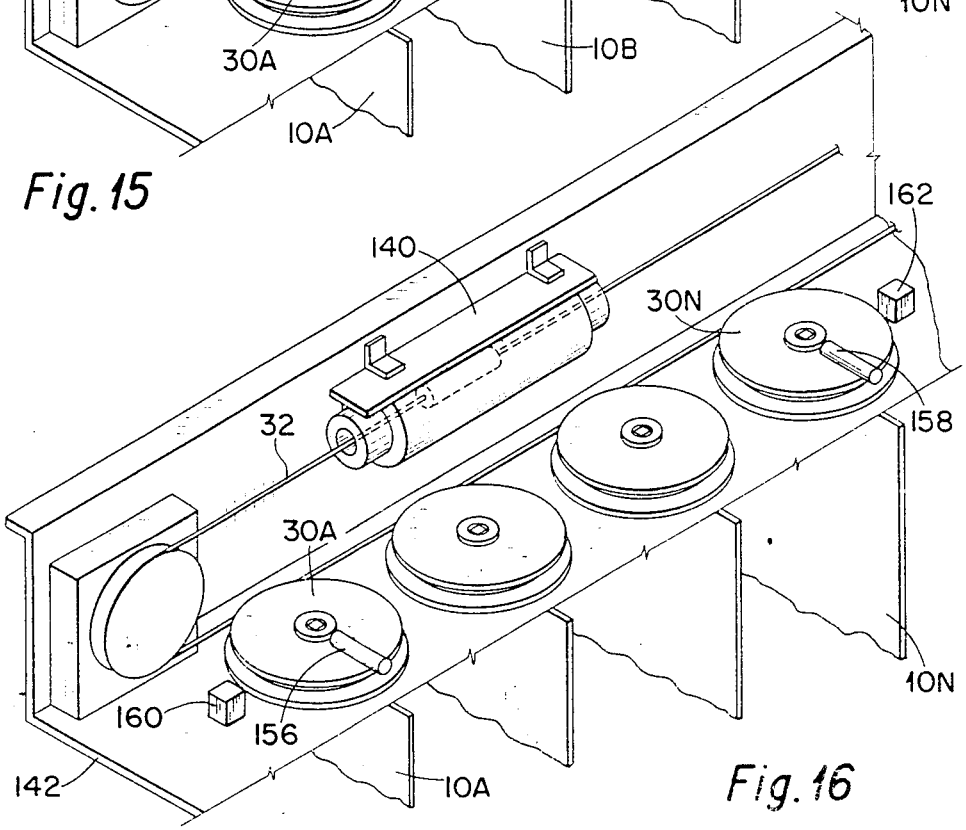
FIG. 16 is still another embodiment of latching mechanism which includes magnets on remote drums.

Attention is next directed to FIG. 15 which shows another embodiment of a magnetic locking or latching means. This includes magnets 144 and 148 on drums 30B and 30N, similarly as in FIG. 13, but on drum 30C there is an iron mass 154. Here, when the drums have rotated in one direction approximately ninety degrees from what is shown, magnet 148 will hold with the iron mass 154 when the motor 26 has completed its stroke. When the motor 26 has completed its stroke in the other direction magnet 144 will be adjacent to iron mass 154 and will "hold" it when power to motor 26 is cut off. FIG. 16 is similar to FIG. 13 except that there are magnets 156 and 158 on drums 30A and 30N, respectively. There, iron masses 160 and 162 supported from the frame 142 such that magnet 156 will be adjacent iron mass 160 when the drum rotates approximately ninety degrees from the position shown, and when the drums rotate ninety degrees in the other direction then magnet 158 will be adjacent iron mass 162.

Figure 17:
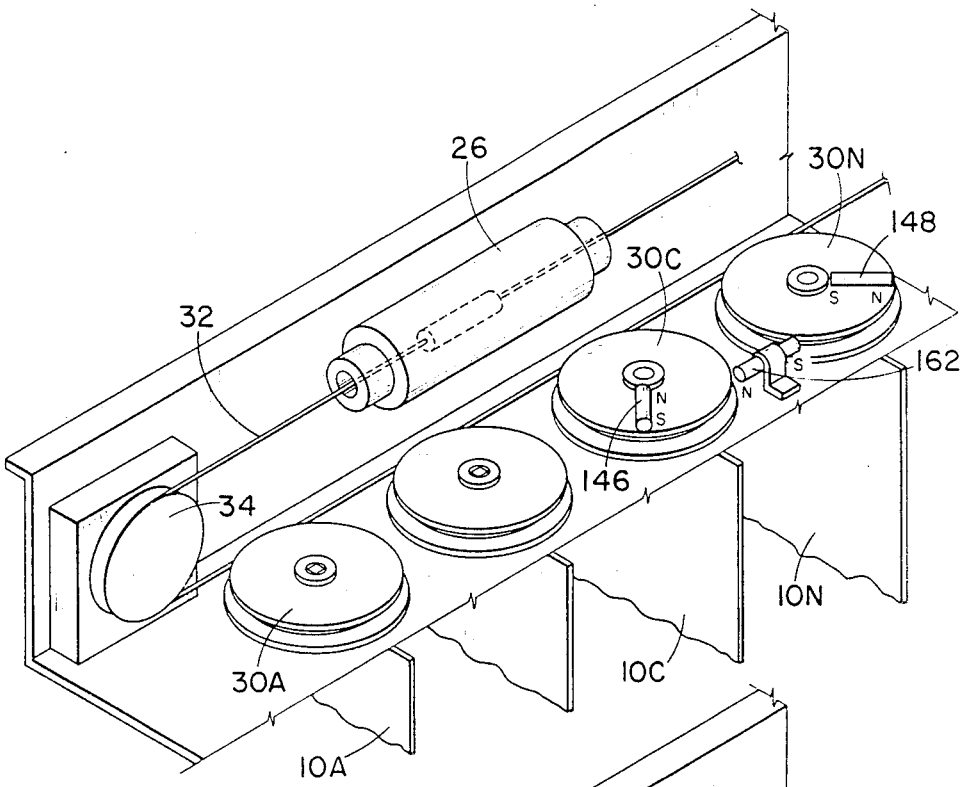
FIG. 17 is yet another embodiment of magnetic latching means having a magnet on two adjacent drums and a magnet supported between the two drums.

FIG. 17 is quite similar to FIG. 13 except that the center magnet 162 is placed between drums 30C and 30N. Here, similarly, as in the others, when the vanes rotate approximately ninety degrees from the position shown, the north pole of magnet 148 will be adjacent the south pole of magnet 162, and when the motor 26 has completed its stroke this will prevent flutter. Likewise, when the vanes rotate ninety degrees in the opposite direction, the south pole of magnet 146 will be adjacent the north pole of magnet 162 and the two will attract and will hold and prevent flutter.

Figure 18:
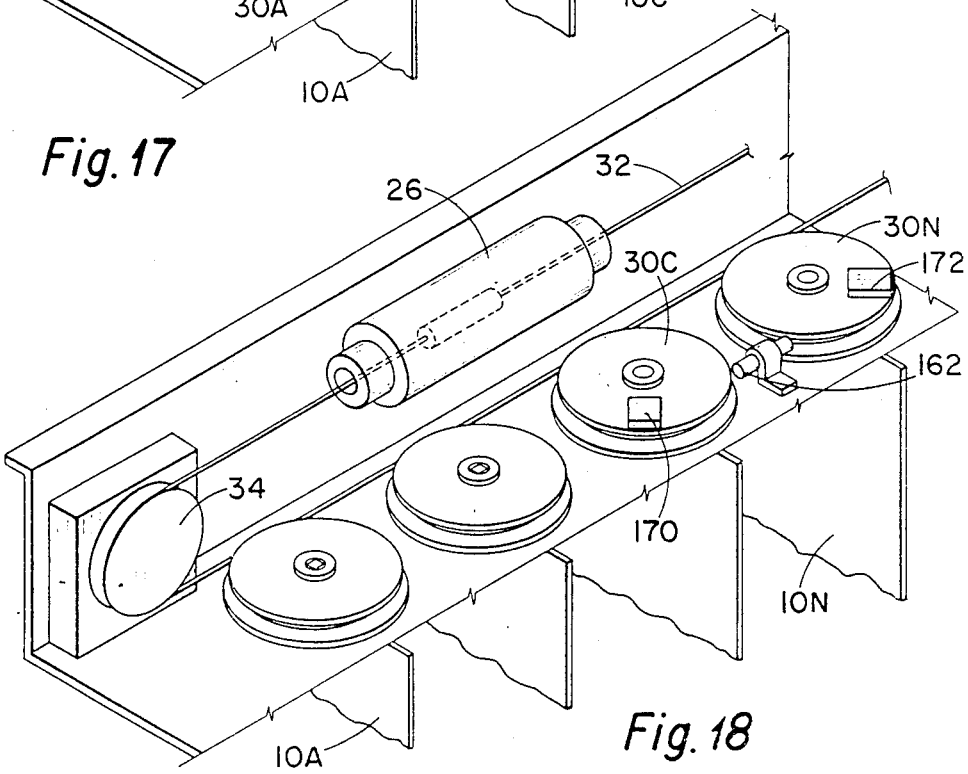
FIG. 18 is similar to FIG. 17 except that it has two iron masses on two adjacent drums with a magnet supported therebetween.

Attention is next directed to FIG. 18, which is quite similar to FIG. 17 except that the magnets 146 and 148 on drums 30C and 30N have been replaced, respectively, by iron masses 170 and 172. When the magnet 162 is aligned with either iron mass 170 or 172 and motor 26 is de-energized, then the magnet will hold the drums in a fixed position to prevent flutter. The magnet must be strong enough to prevent flutter but the motor 26 must be powerful enough that when it starts up to readily overcome the force exerted by the magnet. This, of course, is true in all of the different embodiments of the magnetic latching mechanism.

Figure 19:
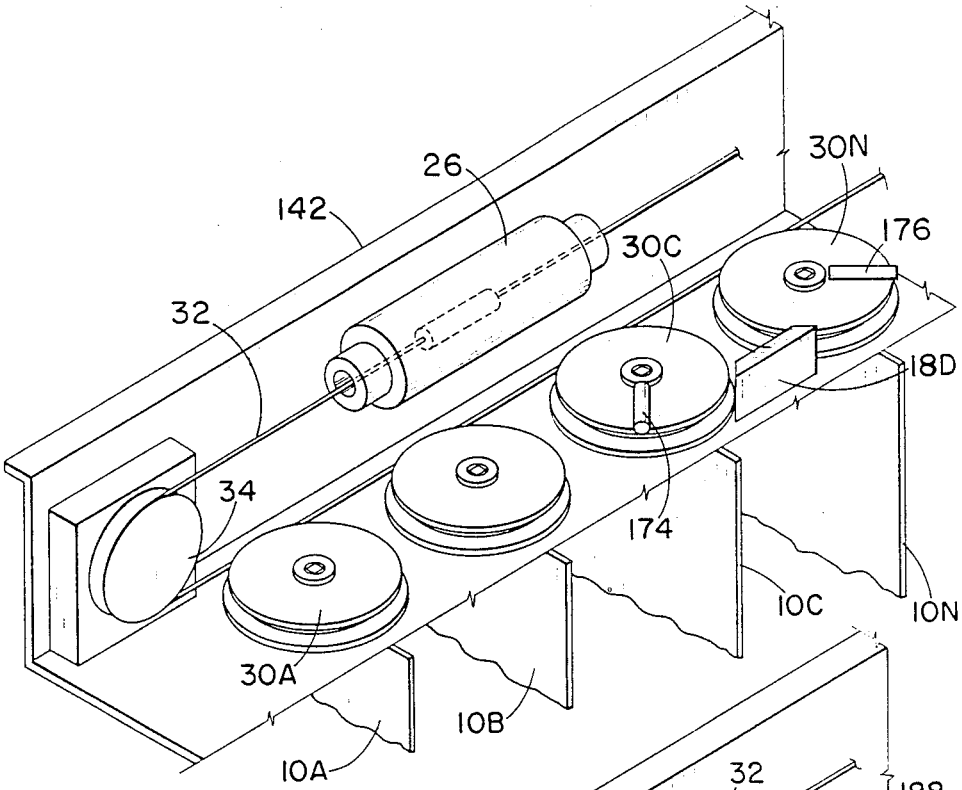
FIG. 19 shows still another embodiment of the latching means showing magnets on two adjacent drums and an iron mass supported therebetween.

Attention is next directed to FIG. 19, which is quite similar to FIG. 17 except the position of the iron mass and the magnets have been reversed. More specifically, drums 30C and 30N, respectively, has magnets 174 and 176 located thereon with the iron mass 180 supported by frame 142 between the two drums 30C and 30N. The operation is believed apparent.

Figure 20:
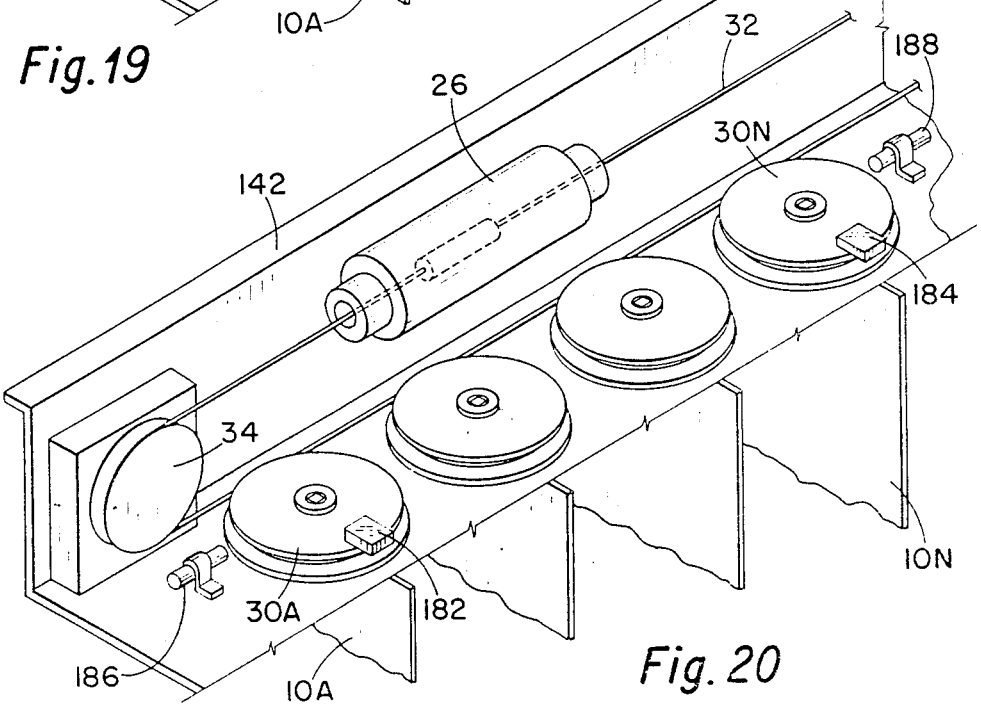
FIG. 20 is still another embodiment showing an iron mass on each of two remote drums with accompanying adjacent magnets.

Attention is next directed to FIG. 20, which is quite similar to FIG. 16 except that the iron masses 182 and 188 are, respectively, on drums 30A and 30N, and the magnets 186 and 188 are supported from the frame 142. The operation is quite similar to that of FIG. 16.

Figure 21:
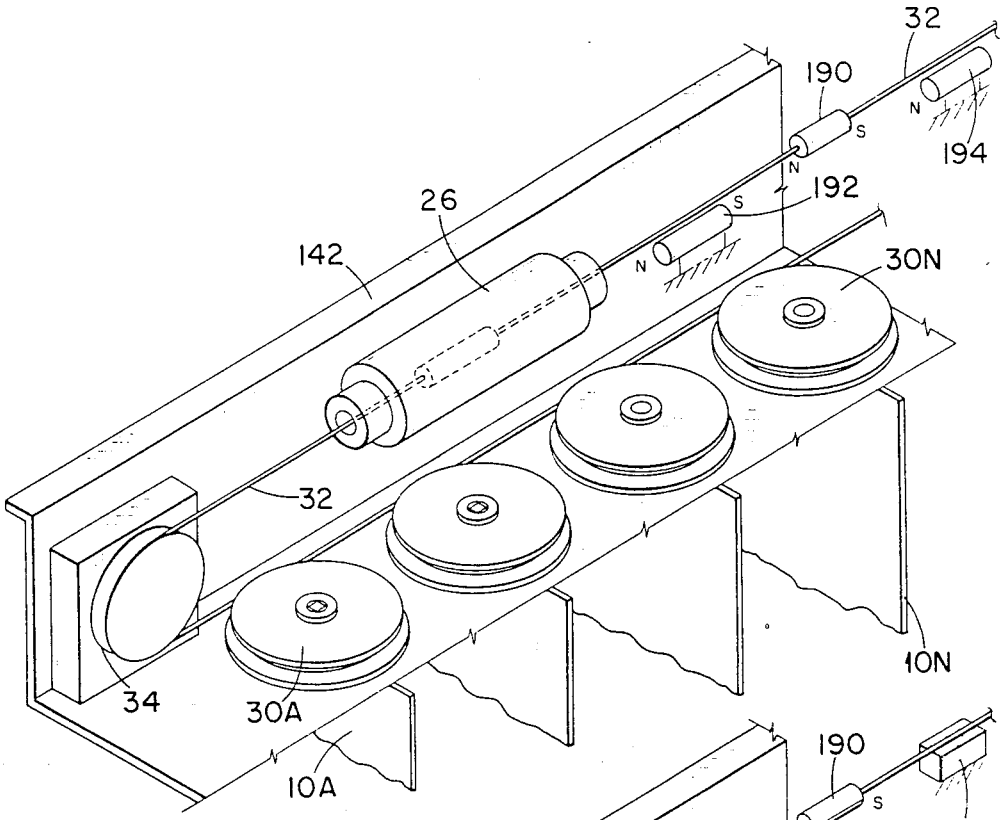
FIG. 21 is another embodiment showing a magnet on a cord to latch with either one of two spaced apart magnets.
Figure 22:
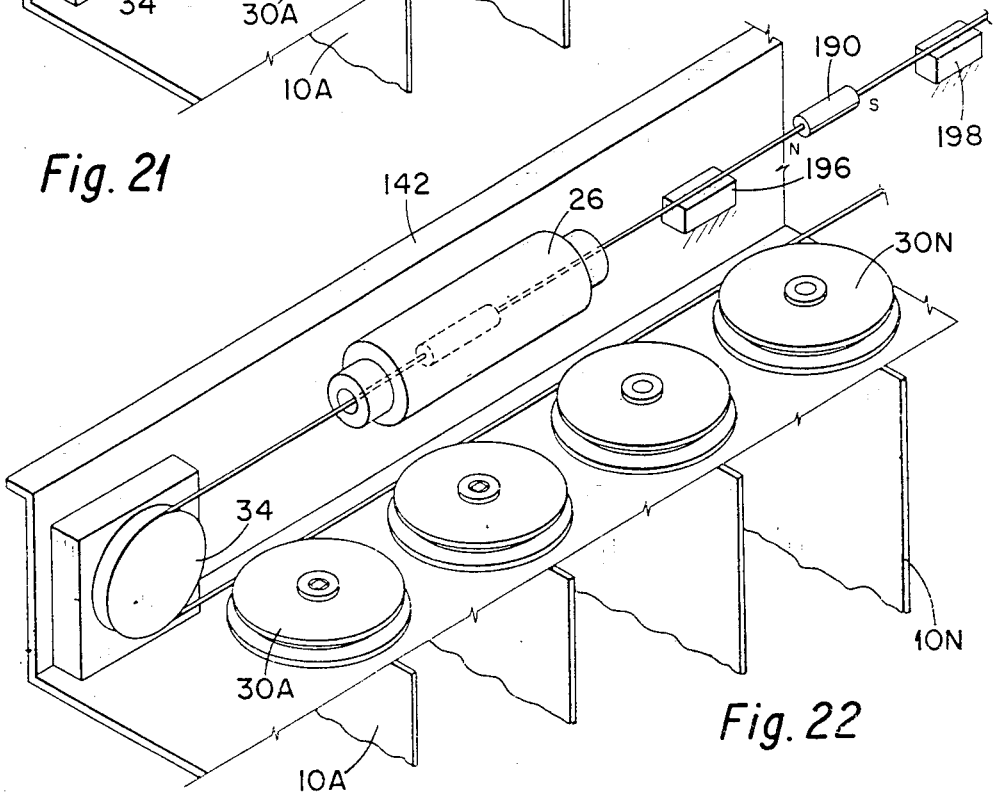
FIG. 22 is similar to FIG. 21 except that it involves a magnet and two separated masses of iron.

FIGS. 21 and 22 show still further embodiments of a magnetic latching means. Shown thereon is a magnet 190 supported on the drive cord 32 itself and is shown as being spaced between magnets 192 and 194, which are supported from frame 142. The magents 194 and 192 are so positioned with respect to magnet 190 that when the vanes 10 through 10N are rotated approximately one-hundred-eighty degrees (which would be to form the flat display surface as shown in FIG. 1), then one pole of magnet 190 would be aligned with the opposite pole of one of the magnets, and when the device is rotated approximately one-hundred eighty degrees in the opposite direction, then the other pole of the magnet 190 would be aligned with the opposite pole of the other magnet. FIG. 22 is very similar to FIG. 21 except that magnets 192 and 194 have been replaced by iron masses 196 and 198.

Figure 23:
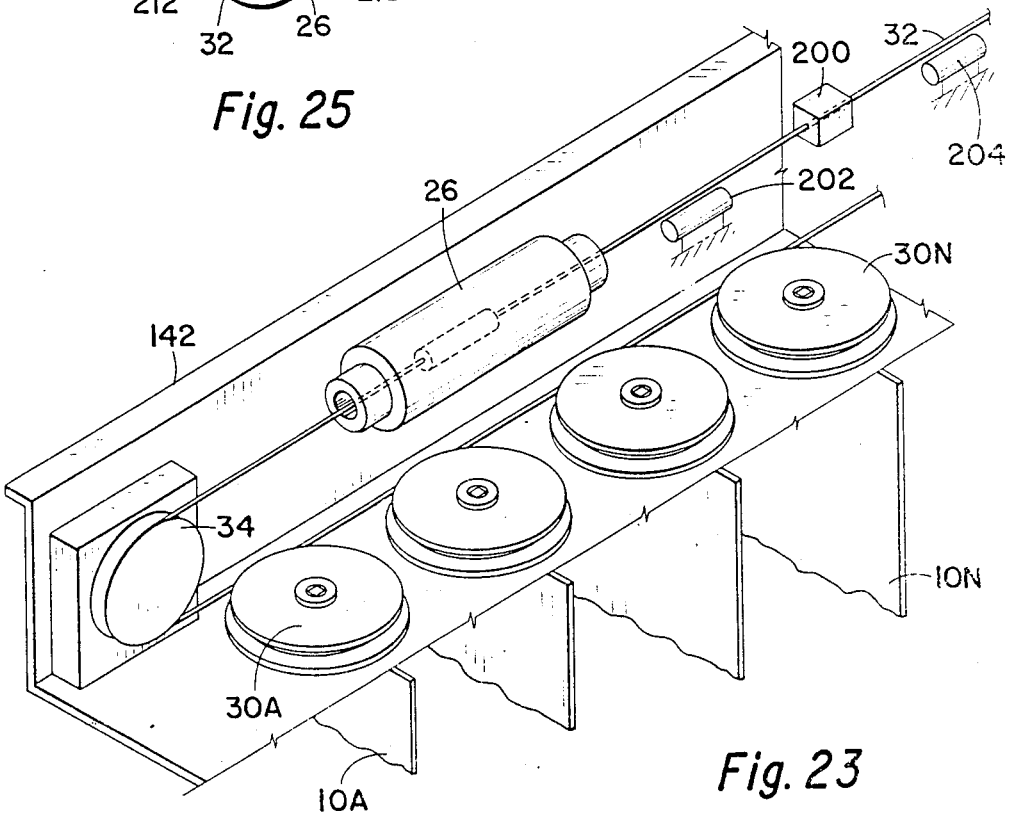
FIG. 23 is similar to FIG. 22 except there is one iron mass on the drive cord and two spaced apart magnets.

FIG. 23 is very similar to FIG. 22 except that the magnets and iron masses have been reversed. In FIG. 23 there is an iron mass 200 on cord 32 and there are two spaced apart magnets 202 and 204 supported from frame 142.

Figure 24:
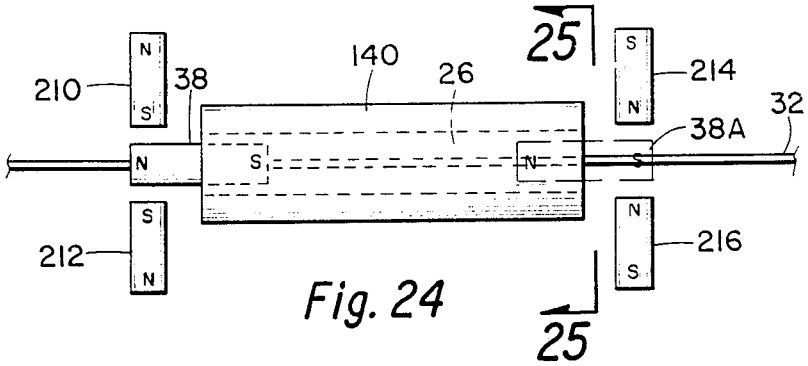
FIG. 24 is a plan view of another magnetic locking system.
Figure 25:
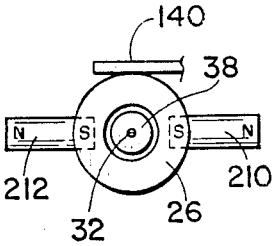
FIG. 25 is a section taken along the line 25—25 of FIG. 24.

FIGS. 24 and 25 illustrate still another locking system. Shuttle cylinder 38 is shown in one position on the left. It is shown in its alternate position as 38A. In one system only locking magnet 210 and 214 may be used. However, the use also of magnets 212 and 216 give a more balanced system result. These magnets may lock in a similar manner to that described above for the other locking magnets.

While this invention has been described with a certain degree of particularity, it is manifest that many changes may be made in the details of construction in the arrangement of component without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed is:

1. An improved driving device for an alternately exhibiting Display One and Display Two of a display board which has a first frame, a set of a plurality of relatively flat and stiff vanes, each vane being supported at one end from said frame at a pivot and rotatable so that in one position, the vanes form an essentially flat surface with a first display area and when rotated a selected amount, form a second display area, the improvement characterized by:

a linear motor means for providing reciprocal motion and supported by said frame;

a pulley mounted on the upper end of each of said vanes;

a drive cord whose two ends are connected to said linear motor forming a loop, said drive cord being wrapped around each said pulley such that movement of said drive cord rotates each said vane through rotation of said pulley.

2. A device as defined in claim 1 including a shuttle cylinder within said motor and the two ends of said cord are connected thereto and in which said pulley includes a drum having a face and an edge upon which said cord is wound in one loop and a clutch plate mounted against said face of said drum, and removable means for holding said clutch plate against said drum.

3. A device as defined in claim 1 including a shuttle cylinder in said motor and including magnetic blocks positioned near the end travel points of said shuttle cylinder.

4. A device as defined in claim 1 being further characterized by including a shuttle cylinder within said motor and a shaft connector from said shuttle cylinder to said drive cord.

5. A device as defined in claim 1 being further characterized by including a shuttle cylinder within said motor and in which said drive cord is mounted in a continuous loop between a first pulley and a second pulley and wherein said first pulley is a double grooved pulley, a third pulley spaced from said first pulley, a second drive cord making a loop over each said first and said third pulley and in which said second drive cord is connected to said linear motor, and a mass on said second drive cord on the portion of the cord parallel to that portion of the cord to which the motor is mounted.

6. A device as defined in claim 1 in which said first pulley and said second pulley are double grooved, each having a smaller radius groove and a larger radius groove, a first drive cord connected around said smaller radius pulley and connected to turn each said vane and a second drive cord connected at opposite ends to a shuttle cylinder within said motor and looped around the larger size groove of each said pulley.

7. A device as defined in claim 1 in which one pulley on each loop around each said drum means is fixed to said drum.

8. A device as defined in claim 1 in which there are at least three pulleys and each said pulley includes a drum in which each of three adjacent drums have magnets thereon.

9. A device as defined in claim 1 in which there are at least three pulleys and each said pulley includes a drum, an iron mass mounted on each of pulleys and a magnet on the drum between the first said two drums.

10. A device as defined in claim 1 in which two adjacent pulleys have magnets mounted thereon and including a magnet mounted between said two pulleys.

11. A device as defined in claim 1 further characterized by including an iron mass on two adjacent pulleys with a magnet supported therebetween.

12. A device as defined in claim 1 including a mass of iron supported above said motor.

13. A device as defined in claim 1 being further characterized by having three aligned pulleys with the center pulley having an iron mass thereon and the two adjacent pulleys with the center pulley having an iron mass thereon and the two adjacent pulleys each having a magnet thereon.

14. A device as defined in claim 1 being further characterized by including a magnet on each of two separated pulleys and a mass supported adjacent each said separated pulleys.

15. A device as defined in claim 1 being further characterized by having a latching mechanism to stop flutter which includes a magnet on each of two adjacent pulleys and an iron magnet between said two adjacent pulleys.

16. A device as defined in claim 1 being further characterized by including a latching mechanism which includes an iron mass on a first and second separated pulley and a first and second magnet supported adjacent to said first and second pulley.

17. A device as defined in claim 1 being further characterized by having a latching mechanism which includes a first magnet mounted on said drive cord and a first and second magnet spaced apart from each other on either side of said magnet.

18. A device as defined in claim 1 being further characterized by including a magnet mounted on said drive cord and a first and a second iron mass supported on either side of said magnet.

19. A device as defined in claim 1 being further characterized by including an iron mass mounted on said drive cord and a first and second spaced apart magnet supported on opposite sides of said iron mass.

20. A device as defined in claim 1 being further characterized by including two magnets on each end of said motor and being aligned perpendicular to the axis of said motor.

21. An alternating billboard for alternately exhibiting Display One and Display Two which comprises:

a first frame;

a set of a plurality of relatively rigid and flat vanes, each vane being supported at one end from said frame at a pivot and rotatable so that in one position, the vanes form an essentially flat surface first display area and when rotated a selected amount in the reverse direction form a second display area;

a motor supported by said frame;

a pulley mounted on one end of each of said vanes;

a drive cord having two ends each of which is connected to said motor forming a loop, said motor means being of a character to pull one end of said drive cord in one direction and the other end in an opposite direction, each said pulley includes a drum having a face and an edge upon which said cord is wound in a loop and a clutch plate mounted against said face of said drum, and removable means for holding said clutch plate against said drum.

22. An alternating display board for alternatingly exhibiting Display One and Display Two which comprises:

a first frame;

a plurality of relatively flat and stiff vanes, each vane being supported at one end from said frame at a pivot and rotatable so that in one position the vanes form an essentially flat surface with a first display area that when rotated a selected amount, form a second display area;

a motor means having a reciprocating member and supported by said frame;

a pulley mounted on the upper end of each of said vanes;

a drive cord interconnecting each said pulley with its adjacent pulley such that movement of the drive cord in one direction rotates the vane through rotation of said pulley and when moved in the other direction causes rotation of the vanes in the opposite direction;

magnetic blocks positioned near the end travel points of said reciprocating member;

means connecting said drive cord to said motor.

23. A motion display device for alternately exhibiting Display One and Display Two which comprises:

a first frame;

a linear motor supported by said frame;

a pulley mounted on the upper end of each said vanes;

a drive cord wrapped about each said pulley such that movement of said drive cord rotates each said vane through rotation of said pulley, said cord made of a plurality of parts;

a shuttle cylinder within said motor having a travel between first and second points and with one part of said cord connected to one side of said shuttle cylinder and a second part of said cord connected to the other end; and, said pulley further including a drum having a face and an edge upon which said cord is wound and a clutch plate mounted against said face of said drum and removable means for holding said clutch plate against said drum.

24. A device as defined in claim 23 including magnetic blocks positioned near the end travel points of said shuttle cylinder.

25. A device as defined in claim 24 including a mass mounted on said drive cord and first and second spaced-apart magnets spaced on opposite side of said iron mass.

26. A device as defined in claim 25 including a mass of iron supported above said motor.

27. An improved driving device for an alternately exhibiting Display One and Display Two of a display board which has a first frame, a set of a plurality of vanes, each vane being supported at one end from said frame at a pivot and rotatable so that in one position, the vanes form an essentially flat surface with a first display area and when rotated a selected amount, form a second display area, the improvement characterized by:

a motor means for providing reciprocal motion and supported by said frame;

a pulley mounted on the upper end of each of said vanes;

a drive cord whose two ends are connected to said motor means forming a loop, said drive cord being wrapped around each said pulley such that movement of said drive cord rotates each said vane through rotation of said pulley;

said pulley including a drum having a face and edge upon which said cord is wound in one loop and a clutch plate mounted against said face of said drum and removable means for holding said clutch plate against said drum.

28. An improved driving device for alternating exhibiting Display One and Display Two of a display board which has a first frame, a set of a plurality of vanes, each vane being supported at one end from said frame at a pivot and rotatable so that in one position, the vanes form an essentially flat surface with a first display area and when rotated a selected amount, form a second display area, the improvement characterized by:

a linear motor supported by said frame;

a pulley mounted on the upper end of each of said vanes;

a drive cord whose two ends are connected to said linear motor forming a loop, said drive cord being wrapped around each said pulley such that movement of said drive cord rotates each said vane through rotation of said pulley;

said motor including a shuttle cylinder within said motor and a shaft connector from said shuttle cylinder to said drive cord.

* * * * *